US005552816A

United States Patent [19]

Oda et al.

[11] Patent Number: 5,552,816

[45] Date of Patent: Sep. 3, 1996

[54] INK TANK, INK-JET CARTRIDGE AND INK-JET RECORDING APPARATUS

[75] Inventors: Kazuyuki Oda; Yoshihiko Fujimura; Jun Isozaki, all of Kanagawa, Japan

[73] Assignee: Fuji Xerox Co., Ltd., Tokyo, Japan

[21] Appl. No.: 68,142

[22] Filed: May 28, 1993

[30] Foreign Application Priority Data

May 29, 1992 [JP] Japan ..... 4-138245

[51] Int. Cl.[6] ..... B41J 2/175

[52] U.S. Cl. ..... 347/86

[58] Field of Search ..... 347/86, 87, 37; 222/105, 185

[56] References Cited

U.S. PATENT DOCUMENTS

| | | | |
|---|---|---|---|
| 4,183,031 | 1/1980 | Kyser et al. | 347/86 |
| 4,628,334 | 12/1986 | Dagna et al. | 347/86 |
| 4,630,758 | 12/1986 | Mutoh | 347/87 |
| 4,719,475 | 1/1988 | Kiyohara et al. | 347/86 |
| 4,929,969 | 5/1990 | Morris | 347/87 |
| 4,931,811 | 6/1990 | Cowger et al. | 347/87 |
| 5,047,790 | 9/1991 | Cowger et al. | 347/87 |
| 5,119,115 | 6/1992 | Buat et al. | 347/86 |
| 5,359,357 | 10/1994 | Takagi et al. | 347/49 |

FOREIGN PATENT DOCUMENTS

| | | |
|---|---|---|
| 62-231759 | 10/1987 | Japan . |
| 63-87242 | 4/1988 | Japan . |
| 2-34349 | 2/1990 | Japan . |

OTHER PUBLICATIONS

"An Optimization Study of a Drop–on–Demand Ink Jet Print Head Cartridge", Michael F. Baumer, et al., IS & T's Seventh International Congress on Advances in Non–Impact Printing Technologies, Vol. 2, pp. 96–106.

*Primary Examiner*—John E. Barlow, Jr.
*Attorney, Agent, or Firm*—Finnegan, Henderson, Farabow, Garrett & Dunner, L.L.P.

[57] ABSTRACT

Ink-jet recording apparatus to reduce the change of the pressure of ink in the inside of ink discharge nozzles in an ink-jet recording apparatus as well as to improve the efficiency of use of ink. In the condition where an ink tank is used in an ink-jet recording apparatus, an ink joint provided in the lower end portion of the ink tank communicates with ink discharge nozzles of a head tip. Upon reception of air pressure from above, ink kept by a porous ink keeper stored in the inside of the ink tank is permitted to be supplied to the head tip. The ink tank is formed so that the internal volume of the ink tank increases in order from the lower portion to the upper portion. Accordingly, when the initial residual quantity of ink is relatively large, the change of the pressure (negative pressure) of ink in the inside of the head tip as caused by consumption of ink can be reduced. Further, when the residual quantity of ink is small, ink is collected into a small sectional area region in the lower portion of the ink tank. Accordingly, the finally residual quantity of ink can be reduced.

4 Claims, 6 Drawing Sheets

INK TANK, INK-JET CARTRIDGE AND INK-JET RECORDING APPARATUS

BACKGROUND OF THE INVENTION

1. Field of the Invention

The present invention relates to an in-jet cartridge, including a head cartridge and an ink tank which are detachably attached to each other, which is used in an ink-jet recording apparatus, and also relates to an ink-jet recording apparatus having such an ink-jet cartridge. The present invention particularly relates to an ink-jet cartridge and an ink-jet recording apparatus in which a change in pressure of the ink in the inside of ink discharge nozzles in the head cartridge is reduced.

2. Prior Art

Heretofore, as an ink-jet cartridge used in an ink-jet recording apparatus, there is known an ink-jet cartridge of the type constituted by a head cartridge having an ink-jet recording head and a tank holder, and an ink tank capable of being attached to and detached from the tank holder.

From the point of view of reduction in cost, this type ink-jet cartridge is more advantageous than an ink-jet cartridge including a head cartridge and an ink tank which are prohibited from being detached from each other, because this type ink-jet cartridge is such that only the ink tank can be exchanged at the time of consumption of ink. In an ink-jet printer using such an ink tank, there are some cases where the liquid surface of ink in the ink tank is higher than the surface of the ink discharge nozzles of the recording head. In these cases, water head difference pressure caused by the difference in level of the liquid surface of ink is imposed on ink in the inside of the ink discharge nozzles of the recording head, so that ink flows out of the nozzles. To prevent the outflow of ink, a negative pressure generating means is required for applying a negative pressure into the ink tank.

As a method for storing ink in an ink tank, there is generally and widely used a method incorporating capillary force (liquid keeping force in accordance with a capillary phenomenon) of a soft porous ink keeper such as sponge disposed in the ink tank to thereby hold ink, as described in Japanese Patent Unexamined Publication Nos. Sho-63-87242 and Hei-2-34349.

In the case where an ink tank having such a porous ink keeper put therein is used, there is no generation of capillary force if the ink tank is entirely filled with ink. As a result, the pressure in the inside of the ink discharge nozzles becomes equal to the atmospheric pressure to thereby bring about leakage of ink out of the nozzles. Therefore, the ink tank is conventionally used so as to be filled with ink by about 70% with respect to the whole volume of the ink tank, because it is impossible to entirely fill the ink keeper with ink.

In this case, ink is kept by the capillary force of a portion where the ink keeper is not filled with ink, so that the pressure of ink in the inside of the ink discharge nozzles is kept in at a predetermined negative value (for example, −30 $mmH_2O$).

In the case where the above-mentioned ink keeper is used, when the volume of the ink keeper portion not filled with ink increases the consumption of ink, the capillary force increases so that the ink with which the ink keeper is filled partly remains in the ink keeper without being consumed. Accordingly, there arises a problem in that the percentage of filling ink used is only about 80%. Therefore, not only it is difficult to reduce the size of the cartridge, because the efficiency of use of the volume of the ink tank is in the range of only from about 50% to about 60%, but reduction in running cost is inhibited because the efficiency of use of ink is inferior.

Further, as the residual quantity of ink decreases, the water head pressure caused by the difference in the level of the ink tank decreases and the above-mentioned capillary force increases. Accordingly, there occurs an increase of the negative pressure in the inside of the ink discharge nozzles. The increase of the negative pressure causes instability of the characteristic of jetting ink from the recording head. Therefore, a method in which a pressure adjusting valve is provided between the ink tank and the recording head has been proposed as described in Japanese Patent Unexamined Publication No. Sho-62-231759. The proposed method cannot be adapted for practical use because the pressure adjusting valve is apt to be broken down due to the injury of the valve, the blocking of the valve, etc., and because leakage of ink out of the ink tank occurs when the valve is broken down.

Further, as an idea for suppressing the increase of the negative pressure of ink in the ink filling type ink tank using a porous member in its inside, there has been published "An Optimization Study Of A Drop-On Demand Ink Jet Print Head Cartridge" (Michael F. Baumer et al., issued by IS&T, Jun. 10, 1991, IS&T's Seventh International Congress on Advances in Non-impact Printing Technologies, Volume 2, pp. 96–106). In this literature, melamine foam is used as the porous member, and there is proposed an ink tank having such a shape that the compression rate of the melamine foam increases in accordance with the height of the ink tank. That is, the ink tank is formed so that its upper portion has a smaller sectional area but the sectional area of the ink tank increases in the order from its upper portion to its lower portion. Further, the ink tank is filled with the melamine foam so that the compression rate of the melamine foam becomes higher at its upper portion.

In this type ink tank, the change of the water head pressure caused by the difference in level of the ink tank can be canceled by changing the compression rate of the melamine foam. The increase of the compression rate of the melamine foam, however, brings about a large final residual quantity of ink. Accordingly, the efficiency of use of ink is still small.

To reduce the change of the water head pressure, it is thought of that the height of the ink tank maybe reduced. In the case where the height of the ink tank is merely reduced, however, the horizontal sectional area of the lower portion of the ink tank must be large if the internal volume of the ink tank is not changed. As a result, an ink tank supporting portion of the head cartridge becomes large in its plane shape. Further, the ink tank supporting portion of the head cartridge is generally supported by the bottom portion of the head carriage of the ink-jet recording apparatus. In this case, the bottom surface of the head carriage for supporting the head cartridge also becomes large in its plane shape. Furthermore, the fact that the height of the ink tank is reduced means that the ink tank is disposed in proximity to the bottom surface of the head carriage. As described above, when the plane shape of the bottom surface of the head carriage increases, a large space in a horizontal surface is spent in the periphery of the lower portion of the head carriage.

In the ink-jet recording apparatus, however, various constituent elements (for example, head carriage movement control members such as a belt for driving the head carriage, a slit train of a predetermined pitch for detecting the position of the head carriage through a photosensor, etc., conveyance members for conveying a recording sheet, and the like) must be disposed in the periphery of the lower portion of the head cartridge. In this case, when the height of the ink tank is merely reduced, the plane shape of the lower portion of the head carriage for supporting the ink tank increases. As a result, it is difficult to secure a space for arrangement of the various constituent elements.

SUMMARY OF THE INVENTION

In such circumstances, an object of the present invention is to reduce the change of the pressure of ink in the inside of ink discharge nozzles in an ink-jet recording head and to improve the efficiency of the use of ink without increasing the plane shape of a head carriage.

To solve the above-mentioned problems, according to a first aspect of the present invention, an ink-jet recording apparatus is provided for performing ink-jet recording on a recording sheet by means of ink discharged from ink discharge nozzles, the ink-jet recording apparatus comprising an ink tank wherein under the condition that the ink tank is used in the ink-jet recording apparatus, the ink tank is provided with an ink joint at its lower end portion for communication with the ink discharge nozzles, and is provided with an air communication hole formed at its upper end portion for communication with air, the ink tank having a shape such that a horizontally sectional area of the ink tank increases from a lower portion to an upper portion thereof, and the ink tank having a porous ink keeper set in its inside.

According to second aspect of the present invention, an ink-jet cartridge is provided which comprises a head cartridge including a tank holder for removably holding an ink tank, a head side ink joint, a head tip provided with a plurality of ink discharge nozzles, and a manifold for temporarily holding ink to be supplied from the head side ink joint to the ink discharge nozzles, the head cartridge being removably attached to a head carriage driven to reciprocate in a main scanning direction, the ink tank being detachably attached to the tank holder, the ink tank including a tank side ink joint provided at its lower portion and connected to the head side ink joint at the time of the attachment of the ink tank to the tank holder, and a porous ink keeper being positioned in its inside, wherein under the condition where the ink tank is attached to the tank holder of the head cartridge attached to the head carriage, the ink tank is provided with the tank side ink joint at its lower end portion and is provided with an air communication hole formed at its upper end portion for communication with air, and the ink tank has a shape so that a horizontally sectional area of the ink tank increases from a lower portion to an upper portion thereof.

Further, in accordance with the second aspect of the present invention, the ink discharging direction of the ink discharge nozzles is selected to be in a downward direction in the condition where the head cartridge is attached to the head carriage.

Further, in accordance with a third aspect of the present invention, an ink-jet recording apparatus is provided which comprises an ink-jet cartridge having a head cartridge including a tank holder for removably holding an ink tank, a head side ink joint, a head tip provided with a plurality of ink discharge nozzles, a manifold for temporarily holding ink to be supplied from the head side ink joint to the ink discharge nozzles, and an ink tank removably attached to the tank holder, the ink tank including a tank side ink joint provided at its lower portion and connected to the head side ink joint at the time of the attachment of the ink tank to the tank holder, a porous ink keeper positioned in its inside, and a head carriage to which the head cartridge is detachably attached, the head carriage being driven to reciprocate in a main scanning direction, wherein under the condition where the ink tank is attached to the tank holder of the head cartridge attached to the head carriage, the ink tank is provided with the tank side ink joint at its lower end portion and is provided with an air communication hole formed at its upper end portion for communication with air, and the ink tank has a shape so that the internal volume of the ink tank increases as its position goes up from a lower portion to a upper portion.

In accordance with the first aspect of the present invention, the ink tank of the present application is used after it is attached to the ink-jet recording apparatus for performing ink-jet recording on a recording sheet by means of ink discharged out of the ink discharge nozzles.

In the condition where the ink tank is used in the ink-jet recording apparatus, the ink joint provided at its lower end portion communicates with the ink discharge nozzles. The inside of the ink tank communicates with air through the air communication hole provided at its lower end portion. Upon reception of air pressure from above, ink kept by the porous ink keeper positioned in the inside of the ink tank is permitted to be supplied to the ink discharge nozzles.

The ink tank has a shape such that the horizontally sectional area of the ink tank increases from a lower portion to a upper portion thereof. Accordingly, when the internal volume of the ink tank and the plane shape of the lower portion are selected to be equal to those in the conventional case, the height of the ink tank is reduced. In this case, the head carriage of the ink-jet recording apparatus can support the ink tank securely without increase of the plane shape of the lower portion because the plane shape of the lower portion of the ink tank is equal to that in the conventional case.

In this case, the same space as in the conventional case can be secured in the periphery of the lower portion of the head carriage. Accordingly, there can be secured a space for arrangement of various constituent elements (for example, head carriage movement control members such as a belt for driving the head carriage, a slit train of a predetermined pitch for detecting the position of the head carriage by means of a photosensor, etc., conveyance members for conveying a recording sheet, and the like) required to be disposed in the periphery of the lower portion of the head carriage.

Because the ink tank has a shape such that the horizontally sectional area of the ink tank increases from a lower portion to an upper portion thereof, the change of the pressure (negative pressure) of ink in the inside of the ink discharge nozzles with consumption of ink can be reduced when the initial residual quantity of ink is relatively large. Further, in the ink tank having the same capacity as the conventional ink tank, the height of the ink tank is smaller so that the absolute value of the change of the negative pressure acting on ink in the inside of the ink discharge nozzles can be reduced when the residual quantity of ink is large. In addition, when the residual quantity of ink is small, ink is collected into a small sectional area region of the lower portion of the ink tank. Accordingly, the final residual quantity of ink can be reduced because there occurs concentration of flow paths into the ink joint provided at the lower end portion of the ink tank.

The pressure of ink in the inside of the ink discharge nozzles initially filled with ink is determined on the basis of both water head pressure (positive pressure) determined on the basis of the height of the ink liquid surface and capillary pressure (negative pressure) of the porous ink keeper in the inside of the ink tank. The absolute value of the capillary pressure (negative pressure) increases as the quantity of filling ink decreases. On the other hand, the water head pressure (positive pressure) decreases as the height of the liquid surface decreases. Accordingly, in the case where the pressure of ink in the inside of the ink discharge nozzles is to be kept at a predetermined negative value, a larger quantity of filling ink can be secured as the height of the ink tank decreases in the condition where the volume of the ink tank is not changed. That is, in the condition where the volume is not changed, the ink tank smaller in height is more advantageous than the conventional ink tank larger in height because the initial quantity of filling ink can be increased in the case of the ink tank smaller in height.

In accordance with the second aspect of the present invention, the ink-jet cartridge has a head cartridge and an ink tank. The head cartridge has a tank holder for detachably holding an ink tank, and a head side ink joint.

When the ink tank is attached to the tank holder, the head side ink joint is connected to the tank side ink joint. In this condition, the inside of the ink tank is communicates with the ink discharge nozzles of the head tip through the head side ink joint of the head cartridge and the manifold. As a result, ink kept by the porous ink keeper in the inside of the ink tank is permitted to be supplied to the ink discharge nozzles.

The ink-jet cartridge constituted by the ink tank and the head cartridge is used after it is removably attached to the head carriage driven to reciprocate in a main scanning direction.

In the condition where the ink-jet cartridge is attached to the head carriage, the ink tank of the ink-jet cartridge according to the second aspect of the invention as well as the ink tank according to the first aspect of the invention is provided with the tank side ink joint provided at its lower portion and is with an air communication hole formed at its upper end portion for communication with air, with the ink tank having a shape such that the horizontally sectional area of the present invention increases from a lower portion to a upper portion thereof.

Accordingly, the ink-jet cartridge according to the second aspect of the present invention fulfills the same operation as in the first aspect of the invention because the negative pressure in the inside of the ink discharge nozzles is determined in the same manner as in the first aspect of the present invention.

According to the third aspect of the present invention, in the second aspect of the present invention, the ink discharging direction of the ink discharge nozzles is selected to be in a downward direction in the condition where the head cartridge (H) is attached to the head carriage.

In this case, ink can be supplied to the ink discharge nozzles from the upper portion of the nozzles and can be discharged out of the ink discharge nozzles from the lower portion of the nozzles. Accordingly, ink can be prevented from remaining in the ink discharge nozzles.

In the ink-jet recording apparatus according to a fourth aspect of the invention of the present application and having the above-mentioned characteristic, the ink-jet cartridge attached to the head carriage has the same structure as the ink-jet cartridge according to the second aspect of the invention.

Accordingly, the ink-jet recording apparatus according to the third aspect of the present invention fulfills the same operation as in the second aspect of the invention.

DETAILED DESCRIPTION OF THE PREFERRED EMBODIMENTS

Figure 1:
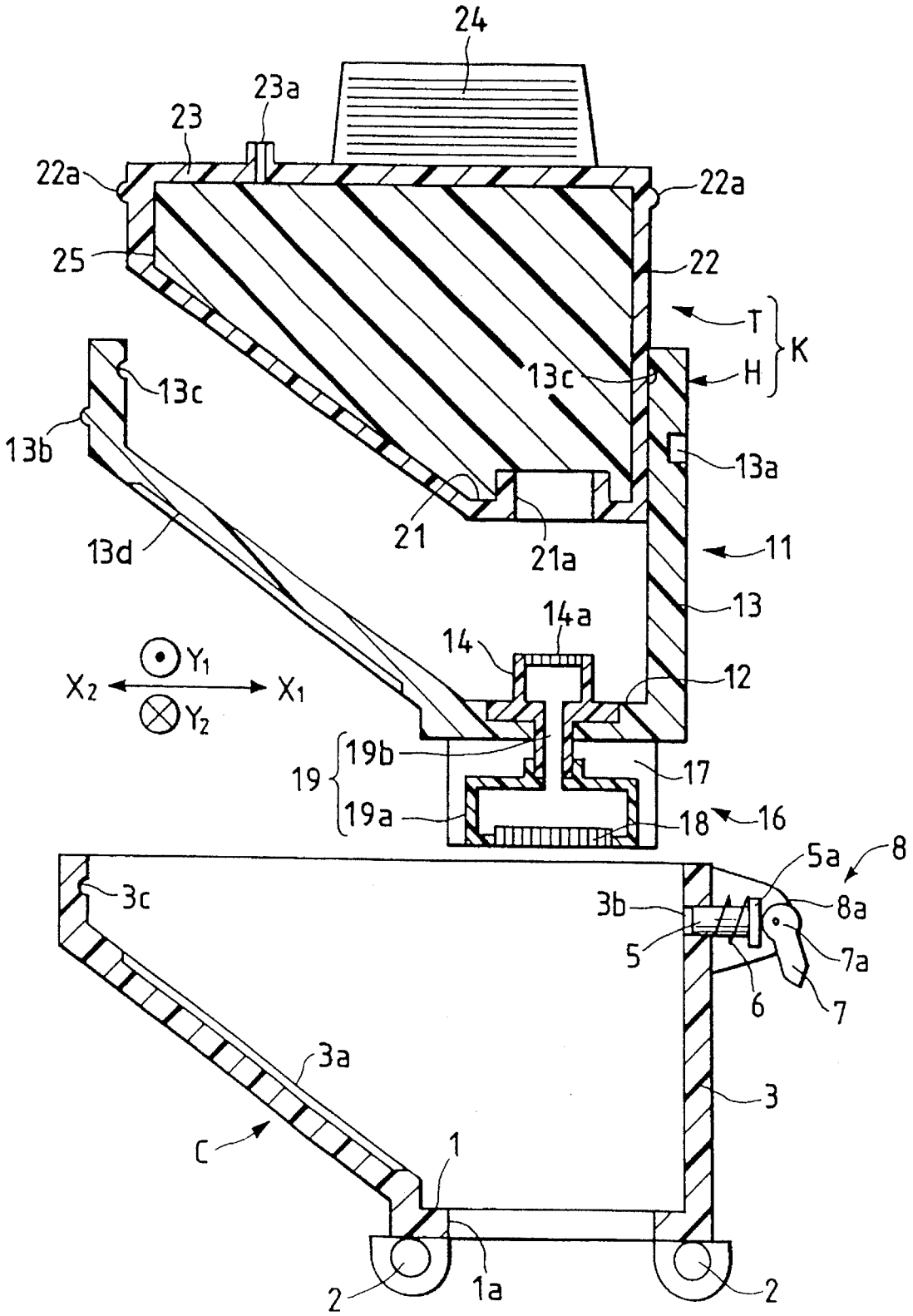
FIG. 1 is an exploded side sectional view of a head carriage, a head cartridge, and an ink tank in an ink-jet recording apparatus according a first embodiment of the present invention.
Figure 2:
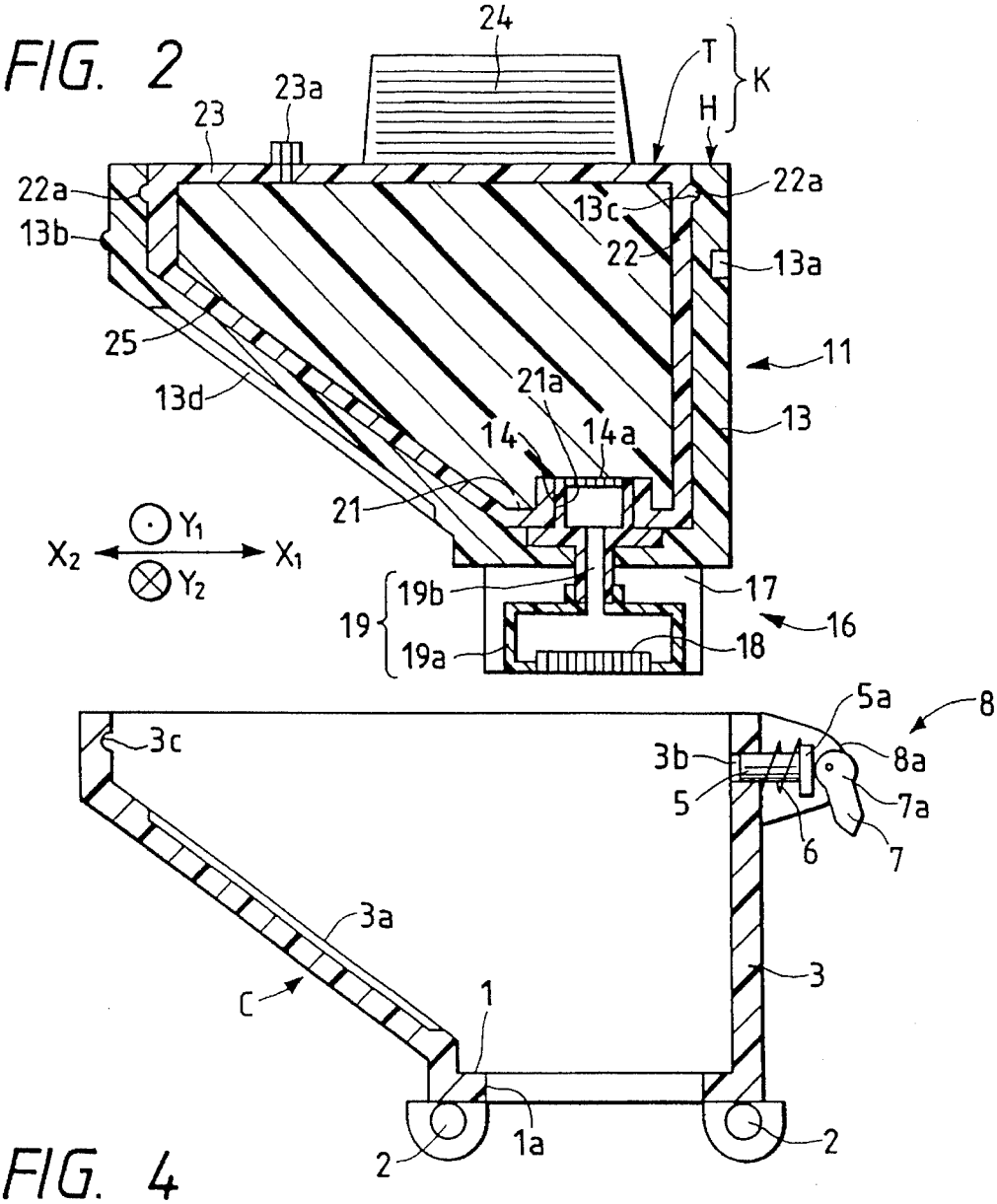
FIG. 2 is a side sectional view of the head carriage and the head cartridge having the ink tank attached thereto according to the first embodiment of the present invention.
Figure 4:
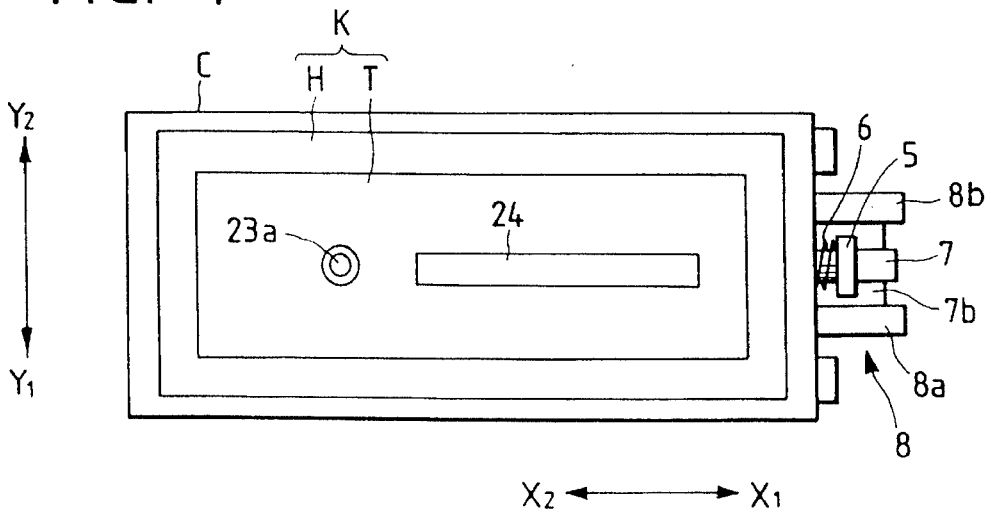
FIG. 4 is a plan view of the first embodiment of the present invention from the arrow IV of FIG. 3.
Figure 3:
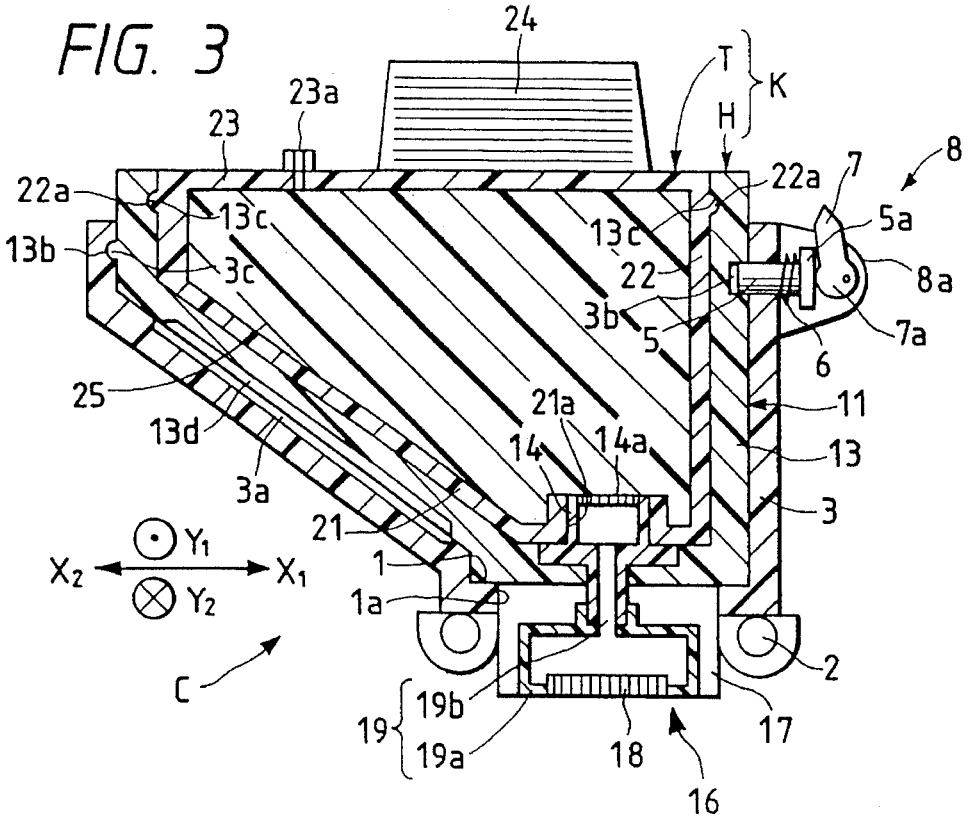
FIG. 3 is a side sectional view showing the condition where the head cartridge having the ink tank attached thereto is attached to the head carriage in the first embodiment of the present invention.

Embodiments of the ink-jet recording apparatus of the present invention will be described below with reference the drawings, although it should be noted that the present invention is not limited to the following embodiments. FIG. 1 is an exploded side sectional view of a head carriage C, a head cartridge H, and an ink tank T in the ink-jet recording apparatus according to a first embodiment of the present invention. A combination of the head cartridge H and the ink tank T attached to the head cartridge H is hereinafter referred to as "ink-jet cartridge K". FIG. 2 is a side sectional view showing the condition where the ink-jet cartridge (that is, the combination of the head cartridge H and the ink tank T attached thereto) K and the head carriage C are separated from each other. FIG. 3 is a side sectional view showing the condition where the ink-jet cartridge (that is, the combination of the head cartridge H and the ink tank T attached thereto) K is attached to the head carriage C. FIG. 4 is a top view of the same.

In the following description of respective embodiments of the present invention, "front" means the direction of the arrow X1 in the drawings (see FIGS. 3 and 4), "rear" means the direction of the arrow X2 in the drawings (see FIGS. 3 and 4), "left" means the direction of the arrow Y1 in the drawings (see FIG. 4), that is, "left" means the left-hand direction (the front direction in FIGS. 1, 2 and 3) with respect to the "front" direction, and "right" means the direction of the arrow Y2 in the drawings (see FIG. 4), that is, "right" means the right-hand direction (the rear direction in FIGS. 1, 2 and 3) with respect to the "front" direction.

In FIGS. 1 through 4, the head carriage C has a carriage bottom wall 1 on which the head cartridge H is set. This carriage bottom wall 1 has a head through-hole la formed therein. The carriage bottom wall 1 has a head through-hole 1*a* formed therein. Rod through-holes 2 and 2 are provided in outer portions of the lower surface of the carriage bottom wall 1 so that guide rods (not shown) extending left and right (in the Y1-Y2 direction) can pass through the rod through-holes 2 and 2. The head carriage C is supported by the guide rods passing through the rod through-holes 2 and 2 so that the head carriage C can reciprocate left and right (in the Y1-Y2 direction, that is, in the main scanning direction in this embodiment).

Similar to the conventional ink-jet recording apparatus, the head carriage C is connected to a drive belt (not shown) and normally suspended in a home position. In the home position, ink discharge nozzles of the head cartridge H attached to the head carriage C are sealed hermetically with a nozzle sealing cap (not shown) by a capping device (not shown).

The not-shown drive belt for driving the head carriage C, the capping device, etc. can be constituted by various known materials, respectively.

A frame-like side wall 3 is provided in the periphery of the carriage bottom wall 1 so as to extend upward. Side surfaces of the side wall 3 (that is, a front surface and left and right surfaces of the side wall 3) except a rear surface of the side wall 3 extend vertically. The rear lower portion of the side wall 3 is inclined upward with respect to the rear direction. A carriage side connection panel storage recess 3*a* is provided in the inner surface of the rear lower portion of the side wall 3. A carriage side connection panel (not shown), which can be electrically connected to a head side connection panel, as will be described later, is stored in the carriage side connection panel storage recess 3*a*.

A lock pin insertion hole 3*b* is provided in the front upper portion of the side wall 3. Further, an engagement recess 3*c* is formed in the inner surface of the rear upper portion of the side wall 3.

A lock pin 5 which can project into the side wall 3 is inserted into the lock pin insertion hole 3*b* of the side wall 3. A flange 5*a* is provided in an outer end portion of the lock pin 5. A compression coiled spring 6 is provided between the flange 5*a* and the outer surface of the side wall. The lock pin 5 is normally urged outward by the compression coiled spring 6.

A pin insertion depth adjusting lever 7 for adjusting the quantity of projection of the lock pin 5 into the side wall 3 is provided in the front surface of the side wall 3. The pin insertion depth adjusting lever 7 has an eccentric cam portion 7*a* provided with a shaft 7*b* (see FIG. 4) extending left and right (in the Y1-Y2 direction). The shaft 7*b* is rotatably supported by a lever support member 8 provided in the outer surface of the side wall 3. The lever support member 8 is constituted by a pair of left and right shaft support members 8*a* and 8*b*.

The outer end surface (the outer surface of the flange 5*a*) of the lock pin 5 is brought into contact with the eccentric cam portion 7*a* of the pin insertion depth adjusting lever 7 to thereby determine the outer position of the lock pin 5.

In FIGS. 1 and 2, the head cartridge H has a tank holder 11. The tank holder 11 is constituted by a bottom wall 12 and a frame-like side wall 13 extending upward from the bottom wall 12. The side wall 13 has an external shape so that it can be fitted to the internal shape of the side wall 3 of the head carriage C. An engagement hole 13*a* is formed in the front surface of the side wall 13. An engagement projection 13*b* is provided on the outer surface of the rear upper portion of the side wall 13. The engagement projection 13*b* is a portion which is engaged with the engagement recess 3*c* formed in the inner surface of the rear upper portion of the side wall 3. The engagement projection 13*b* is shaped like a semisphere so that it can be engaged with the engagement recess 3*c* easily when the head cartridge H is pushed toward the bottom wall 1 of the head carriage C to thereby attach the head cartridge H to the head carriage C in a predetermined position. Engagement recesses 13*c* and 13*c* are formed respectively in front and rear of the upper inner surface of the side wall 13.

A head side ink joint 14 shaped like a cylinder is provided on the upper surface of the bottom wall 12 of the tank holder 11 so as to project upward. The head side ink joint 14 has a disk-like porous filter 14*a* provided in the upper end portion thereof.

An ink-jet recording head 16 is provided in the lower surface of the bottom wall 12 of the tank holder 11. Similar to the conventionally known ink-jet recording head, the ink-jet recording head 16 has a heat sink 17, a head tip 18 supported by the heat sink 17 and provided with a plurality of ink discharge nozzles (not shown), and an ink supply path 19 for supplying ink from the head side ink joint 14 to the inside of the head tip 18. This ink supply path 19 is constituted by a manifold 19*a* for temporarily reserving ink to be supplied to the ink discharge nozzles, an ink communication path 19*b* formed in the inside of the head side ink joint 14, etc.

The plurality of ink discharge nozzles (not shown) in the head tip 18 are formed at a high density. In this embodiment, 128 nozzles are formed at a density of 300 spi. Each of the ink discharge nozzles is provided with a heater (not shown) for generating air bubbles through current conduction to thereby jet ink drops. The jetting of ink drops is performed in the downward direction.

Further, the ink-jet recording head 16 has a printed-wiring substrate (not shown) for supplying an electric signal to the heater provided in each of the ink discharge nozzles in the head tip 18. This printed-wiring substrate is connected to the head side connection panel (not shown) in the head side connection panel storage recess 13d provided in the lower outer surface of the side wall 13 of the tank holder 11. The head side connection panel is brought into contact with the carriage side connection panel (not shown) in the carriage side connection panel storage recess 3*a* when the head cartridge H is attached to the head carriage C, so that these panels are electrically connected to each other.

The structure of the ink-jet recording head 16 per se does not constitute the gist of the present invention. That is, various conventionally known structures can be used as the structure, and the detailed description thereof will be omitted.

The head cartridge H is constituted by constituent elements designated by the reference numerals 11 through 19.

The ink tank T attached to the tank holder 11 of the head cartridge H has a bottom wall 21, a frame-like side wall 22 extending upward from the bottom wall 21, and a top wall 23 for blocking the upper end of the side wall 22. The side wall 22 has an external shape so that it can be fitted to the internal shape of the side wall 13 of the tank holder 11. The internal volume of the ink tank T is formed in such a manner that the horizontally sectional area gradually increases from the lower portion to the upper portion thereof. The internal volume of the ink tank T at the upper end portion is kept constant regardless of the height.

As constituent material of the ink tank T, a material (such as resin, etc.) having stiffness and moderate elasticity and being excellent in durability against ink to thereby make it possible to reserve ink for a long term can be selected from various conventionally known materials.

A connection hole 21*a* as the tank side ink joint connected to the head side ink joint 14 of the tank holder 11 is formed in the bottom wall 21 of the ink tank T. This connection hole 21*a* has a shape so that it can be fitted to the external surface of the head side cylindrical ink joint 14 when the ink tank T is attached to the tank holder 11.

Engagement projections 22*a* and 22*a* are provided respectively on the outer sides of the front and rear surfaces of the side wall 22 of the ink tank T. The engagement projections 22*a* and 22*a* are members which can be engaged with the engagement recesses 13*c* and 13*c* formed respectively in front and rear of the upper inner surface of the side wall 13.

Each of the engagement projections 22*a* is shaped like a semisphere so that the engagement projections 22*a* can be engaged with the engagement recesses 13*c* and 13*c* in the upper inner surface of the side wall 13 easily when the ink tank T is pushed toward the bottom surface 12 of the tank holder 11 of the head cartridge H. Further, the ink tank T can be attached to the tank holder 11 so as to be set in a predetermined position (where the engagement projections 22*a* are engaged with the engagement recesses 13*c* respectively).

An air communication hole 23*a* is provided in the top wall 23 of the ink tank T. Further, a knob 24 is provided on the upper surface of the top wall 23.

Also, a sponge-like ink keeper (soft porous ink keeper) 25 is stored in the inside of the ink tank T. As the ink keeper 25, there can be used polyester felt, for example, with a density of 800 g/m$^3$.

The ink-jet cartridge K is constituted by the head cartridge H and the ink tank T attached to the head cartridge H.

In the above-mentioned embodiment, under the condition that the size (horizontal sectional area) of the lower end portion of the ink tank T and the whole internal volume (ink storage volume) thereof are not changed, the horizontally sectional area of the ink tank T increases in order from the lower portion to the upper portion thereof so that the height of the ink tank T can be reduced as compared with the conventional case in the condition that the above-mentioned values are not changed.

As described above, the same space as in the conventional case can be secured in the periphery of the lower portion of the head carriage C as long as the lower end portion of the head carriage C can be provided with the same size as in the conventional case. Accordingly, a space can be secured for arrangement of various constituent elements (for example, members for controlling the movement of the head carriage, such as a belt for driving the head carriage, a slit train of a predetermined pitch for detecting the position of the head carriage by means of a photosensor, etc., conveyance members for conveying a recording sheet, and the like) which have to be disposed in the periphery of the lower portion of the head carriage.

The pressure (negative pressure) of ink in the inside of the ink discharge nozzles initially filled with ink is determined on the basis of both water head pressure (positive pressure) determined on the basis of the height of the ink liquid surface and capillary pressure (negative pressure) of the porous ink keeper in the inside of the ink tank. The absolute value of the capillary pressure (negative pressure) increases as the quantity of filling ink decreases. On the other hand, the water head pressure (positive pressure) decreases as the height of the liquid surface decreases. Accordingly, in the case where the pressure of ink in the inside of the ink discharge nozzles is to be kept in a predetermined negative value, a larger quantity of filling ink can be secured as the height decreases in the condition that the volume of the ink tank is not changed. That is, in the condition that the volume is not changed, the ink tank smaller in its height is more advantageous than the ink tank larger in its height because the initial quantity of filling ink can be increased in the case of the ink tank smaller in its height.

As described above, in the case where the horizontally sectional area of the ink tank T increases in order from the lower portion to the upper portion, the change of the pressure (negative pressure) of ink in the inside of the ink discharge nozzles can be reduced when the initial residual quantity of ink is relatively large because the change of the water head pressure of the ink is small. In addition, when the residual quantity of ink is small, ink is collected into a relatively small sectional area region of the lower portion of the ink tank T. Accordingly, there occurs concentration of flow paths into ink joints 21*a* and 14 provided in the lower end portion of the ink tank T, so that the final residual value of ink can be reduced.

In the case where the ink-jet cartridge K constituted by the ink tank T and the head cartridge H having the ink tank T attached thereto is to be attached to the head carriage C, the pin insertion depth adjusting lever 7 provided on the head carriage C is turned to a position as shown in FIGS. 1 and 2. In this case, as shown in FIGS. 1 and 2, the lock pin 5 is kept in an outer end position (that is, an attachment/detachment permission position where the attachment/detachment of the head cartridge H is permitted) by the compression coiled spring 6.

In this condition (shown in FIG. 2), when the ink-jet cartridge K is pushed toward the bottom wall 12 of the tank holder 11 of the head carriage C, the ink-jet cartridge K is brought into contact with the bottom surface of the head carriage C (see FIG. 3).

In this condition, the pin insertion depth adjusting lever 7 is turned counterclockwise to a position show in FIG. 3, that is, a detachment prohibition position where the detachment of the head cartridge H and the head carriage C from each other is prohibited.

In this condition shown in FIG. 3, the lock pin 5 is located in the engagement hole 13*a* of the side wall 13 of the tank holder 11 so that the detachment of the head carriage C and the head cartridge H from each other is prohibited by the lock pin 5. Further, the ink tank T is attached at a predetermined position to the head cartridge H by the engagement projections 22*a*.

Thereafter, ink is supplied to the inside of the head tip 18 through vacuuming from the ink discharge nozzles. At this time, the pressure of ink at the junction portion between the ink keeper 25 and the filter 14*a* is selected to be in a range in which there is no occurrence of natural flowing of ink out of the ink discharge nozzles of the head tip 18. In this embodiment, the pressure of ink is selected to be −30 mm$H_2O$.

Figure 5:
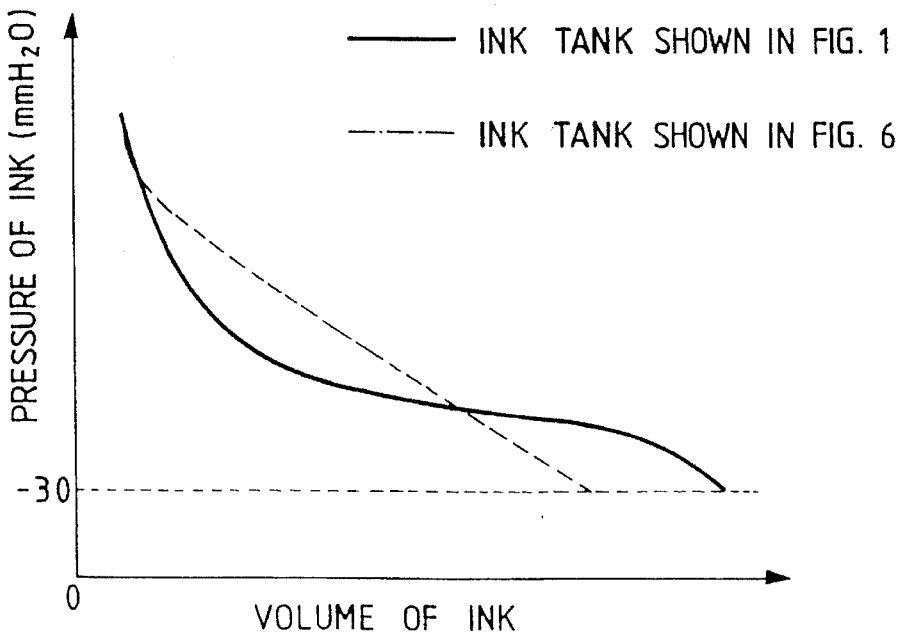
FIG. 5 is a view explaining the operation of the first embodiment of the present invention.
Figure 6A:
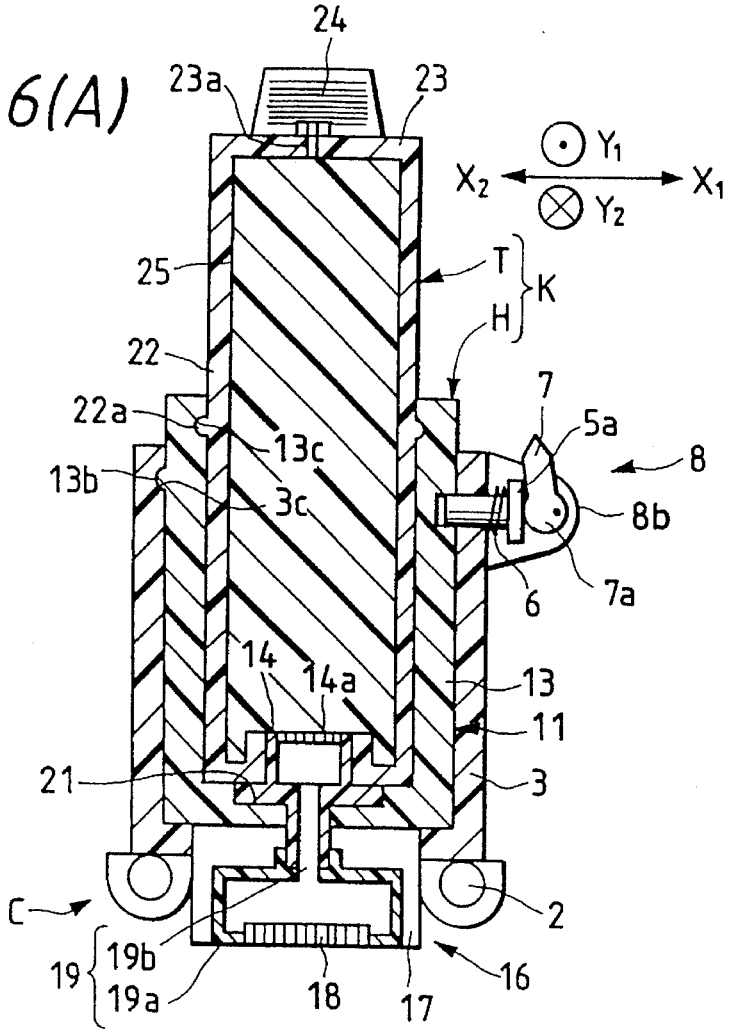
FIG. 6(A) is a side sectional view for explaining a conventional ink supply mechanism.
Figure 6B:
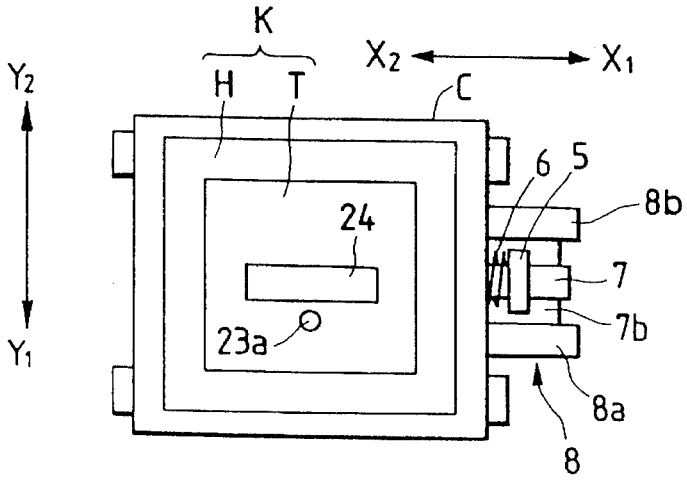
FIG. 6(B) is a top view for explaining a conventional ink supply mechanism.

The change of the pressure of ink has influence on the ink jetting characteristic of the ink discharge nozzles. In FIG. 5, the solid line expresses the change of the pressure of ink versus the quantity of ink measured by using the first embodiment of the present invention. Further in FIG. 5, the broken line expresses the change of the pressure of ink versus the quantity of ink measured by using a conventional ink tank shaped like a rectangular parallelepiped as a comparative example. FIG. 6(A) is a sectional view of an ink supply mechanism having the conventional rectangular parallelepiped ink tank represented in FIG. 5, and FIG. 6(B) is a top view of that ink supply mechanism. In the drawings, the constituent elements corresponding to those in the first embodiment of the present invention are designated with the same reference numerals, and the description thereof will be omitted.

It is found from comparison between the first embodiment (see FIGS. 1 to 4) and the comparative example of FIGS. 6(A) and 6(B) that the two are different in the initial quantity of filling ink. This is because the ink tank T in the first embodiment is smaller in height than the conventional ink tank. The pressure of ink in the conventional ink tank increases linearly as the quantity of ink decreases, while the change of the pressure of ink in the ink tank T of the first embodiment is small before the residual quantity of ink reaches about a half of the whole quantity of ink. This is because the ink tank T is large in the sectional area of the upper portion so that the change of the water head pressure of ink is small. There is no difference in the final residual quantity of ink between first embodiment and the comparative example of FIGS. 6(A) and 6(B).

It is apparent from the above description that not only the change of the pressure of ink can be suppressed but the efficiency of use of ink can be improved by using the ink tank T as compared with the conventional ink tank of FIGS. 6(A) and 6(B).

In the condition shown in FIG. 3, ink-jet recording is performed. A sensor for detecting the position of the pin insertion depth adjusting lever 7 may be provided so that the ink-jet recording (printing operation) can be controlled so as to be performed only when the sensor detects the fact that the pin insertion depth adjusting lever 7 is in a position shown in FIG. 3 (that is, that fact the the head cartridge H is attached to the head carriage C).

In the case where only the ink tank T needs to be exchanged because the ink in the ink tank T becomes empty when the ink-jet recording apparatus is used under the condition shown in FIG. 3, the following procedure is carried out.

That is, when the knob 24 of the ink tank T is pulled under the condition that the lock pin 5 projects into the engagement hole 13*a* of the side wall 13 of the tank holder 11 as shown in FIG. 3 or, in other words, under the condition where the detachment of the head cartridge H from the head carriage C is prohibited, only the ink tank T is detached from the head cartridge H attached to the head carriage C.

After the old ink tank T is taken out as described above, a new ink tank T is attached to the head cartridge H attached to the head carriage C.

Upon attachment of the new ink tank T into the tank holder 11 of the head cartridge H, the semispherical projecting surfaces of the engagement projections 22*a* are brought into contact with the upper end of the tank holder 11. At this time, the side wall 13 of the tank holder 11 is pressed outward by the semispherical projecting surfaces of the engagement projections 22*a*, so that the side wall 13 is deformed elastically.

When the ink tank T is pushed toward the bottom wall 12 of the tank holder 11 under this condition, the ink tank T is guided by the side wall 13 of the tank holder 11. As a result, there is formed an attachment condition where the bottom wall 21 of the ink tank T abuts on the upper surface of the bottom wall 12 of the tank holder 11. At this time, not only the connection hole 21*a* in the bottom wall 21 of the ink tank T is fitted to the outer surface of the cylindrical head side ink joint 14, but also the engagement projections 22*a* on the side wall 22 of the ink tank T are engaged with the engagement recesses 13*c* in the side wall 13.

To exchange the ink-jet cartridge K constituted by the head cartridge H and the ink tank T attached to the head cartridge H, the lock pin 5 is disconnected from the engagement hole 13*a* by turning the pin insertion depth adjusting lever 7 clockwise in the condition of FIG. 3. There arises a condition where the ink-jet cartridge K is permitted to be detached from the head carriage C. Accordingly, in this condition, exchange of the ink-jet cartridge K is performed.

Figure 7:
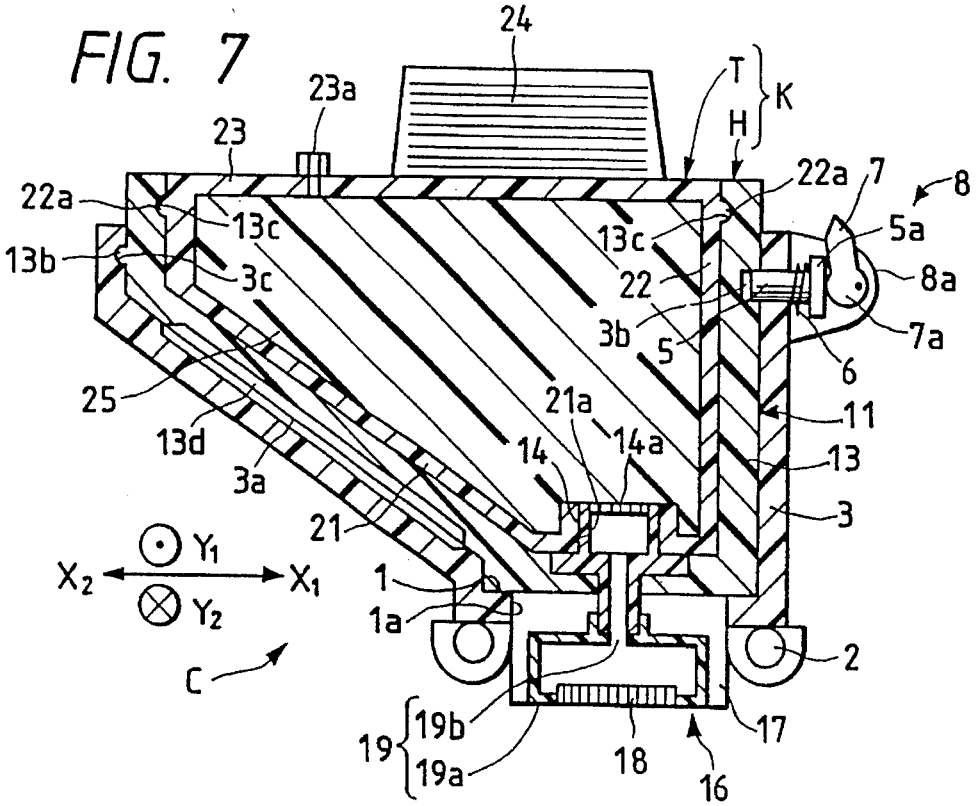
FIG. 7 is a side sectional view showing second embodiment of the present invention.
Figure 8:
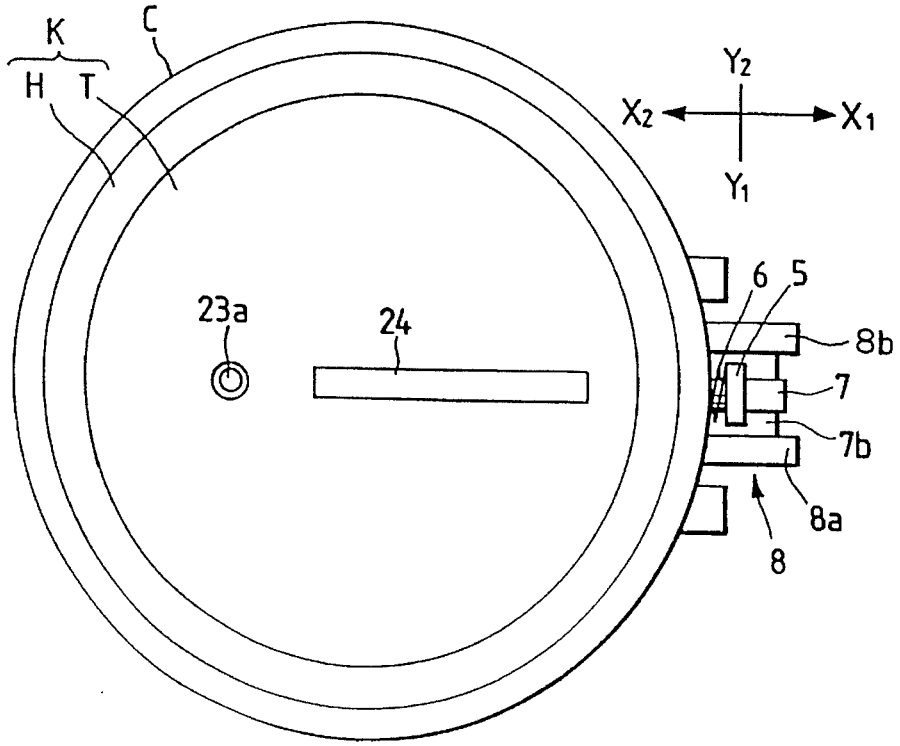
FIG. 8 is a top view of a second embodiment of the present invention, from the arrow VIII of FIG. 7.

The ink-jet recording apparatus according to a second embodiment of the present invention will be described below with reference to FIGS. 7 and 8. FIG. 7 is a side sectional view corresponding to FIG. 3 of the first embodiment and showing the condition where the ink-jet cartridge K is attached to the head carriage C. FIG. 8 is a top view thereof in the manner of FIG. 4 of the first embodiment. In the description of the second embodiment, the constituent elements corresponding to those in the first embodiment are designated with the same reference numerals, and the detailed description thereof will be omitted.

In the second embodiment, the ink tank T is shaped like a cone. This is because the sectional area of the upper portion of the ink tank T is selected to have a large value to thereby reduce the height to suppress the change of the water head pressure of ink. Further, the ink tank T is formed so that the sectional area thereof decreases in order from the upper portion to the lower portion. Accordingly, ink flow paths are concentrated in the bottom surface of the ink keeper 25 in the same manner as in the first embodiment, so that the efficiency of use of ink can be improved.

Figure 9:
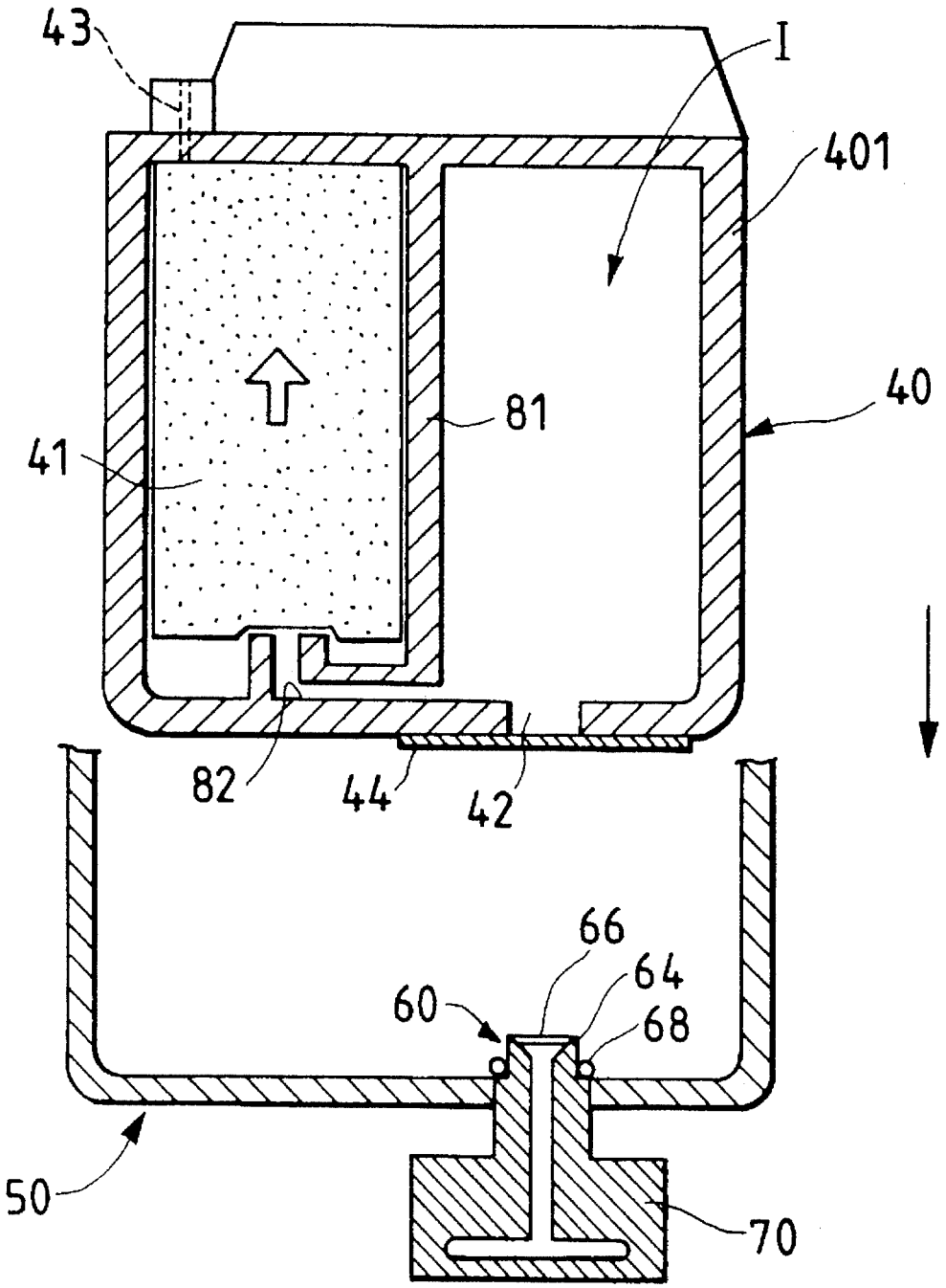
FIG. 9 is a sectional view of a third embodiment of the present invention.

FIG. 9 is a sectional view of a third embodiment of the present invention. An inner portion of an ink room is divided by a partition wall 81 into two ink rooms. An ink keeper 41 is disposed in the first ink room in such a manner that the upper portion of the ink keeper 41 communicates with the atmosphere and a lower portion of the ink keeper 41 is brought into contact with an inner bent portion of the ink tank 401. The second room has an ink supply hole 42 as in the first and second embodiments. Other portions of this embodiment is the same as the first and second embodiments.

The ink is penetrated into the ink keeper 41 and the first ink room. Under the condition where the ink tank is mounted, a negative pressure is generated into the first ink room in the direction of the arrow shown in FIG. 9 so that it avoids the ooze of the ink penetrated into the ink tank from a head 70. The structure of this embodiment is designed to absorb positive pressure which is occurred incurred by changing an external condition. The negative pressure described above functions as follows. First, the ink penetrated within the ink keeper 41 of the first room is consumed. After the ink penetrated within the ink keeper 41 has been consumed, the ink existing in the second room is consumed.

Although embodiments of the present invention have been described in detail, it is to be understood that the present invention is not limited to the above-mentioned embodiments and that various modifications may be made within the spirit of the present invention described in the scope of claims.

For example, the engagement recesses 3*c* and 13*c* and the engagement projections 13*b* and 22*a* engaged therewith may be disposed in the left and right surfaces of the side wall instead of the front and rear surfaces of the side wall. Further, slits may be formed in both sides of each of the engagement recesses 3*c* and 13*c* so that the quantity of elastic deformation of the side wall 3 and 13 in the vicinity of the engagement recess 3*c* or 13*c* is partially increased. Further, the pin insertion depth adjusting lever may be provided on the cam shaft so as to be far from the cam, though the above description is made based upon the case where the pin insertion depth adjusting lever is integrated with the cam. Further, pin insertion depth adjusting levers and lock pins may be provided, respectively, on the front and rear surfaces of the side wall of the head carriage, and means for integrally operating the respective lock pins on the front and rear surfaces may be provided. Further, means for integrally operating the respective lock pins may be formed purely mechanically or may be formed by using an electrical control mechanism.

According to the above-mentioned present invention, the ink tank is smaller in height than the conventional ink tank, and the internal volume of the ink tank increases in order from the lower portion to the upper portion. Accordingly, the initial quantity of filling ink is large, so that the final residual quantity of ink becomes small. Accordingly, the efficiency of use of ink can be improved greatly as compared with the conventional case. Further, the change of the pressure of ink with respect to the residual quantity of ink is flat compared with the conventional ink tank. Accordingly, not only the running cost can be reduced because the efficiency of use of ink is improved, but also the ink jetting characteristic of the ink-jet recording head can be stabilized because the pressure of ink is kept flat.

Further, in the present invention, the lower end portion of the head carriage in the ink-jet recording apparatus can be formed to be the same size as in the conventional case under the condition where the internal volume of the ink tank is not changed but the height of the ink tank is reduced. Accordingly, the same space as in the conventional case can be secured in the periphery of the lower portion of the head carriage.

What is claimed is:

1. An ink tank assembly for use in an ink-jet recording apparatus for recording on a recording sheet with ink discharged from ink discharge nozzles of the ink-jet recording apparatus, the ink tank assembly comprising:

an ink tank having top, bottom, and sidewalls forming an enclosed chamber;

an ink joint at a lower end portion of the ink tank chamber and communicating with the ink discharge nozzles of the ink-jet recording apparatus; and a porous ink keeper filling the ink tank chamber and in engagement with at least the sidewalls, the porous ink keeper storing ink provided to the ink joint during ink-jet recording by the ink-jet recording apparatus, an air communication hole formed at an upper end portion of the ink tank chamber, for communication with atmosphere external to the ink tank chamber, the ink tank chamber being configured to have an area in cross-section which increases from the bottom to the top of the ink tank chamber, and further, the ink tank having at least one sidewall with a surface extending in a direction of movement of a head carriage to which the tank assembly is to be mounted sloping upwards in an outward direction from a sidewall opposite said sloping sidewall.

2. An ink-jet cartridge comprising:

a head cartridge including a tank holder, a head tip with a plurality of ink discharge nozzles, a head side ink joint coupled to the ink discharge nozzles for supplying ink to the ink discharge nozzles, and a manifold for temporarily holding the ink supplied from the head side ink joint to the ink discharge nozzles, the head cartridge being removably attachable to a head carriage driven to reciprocate in a main scanning direction; and an ink tank having top, bottom, and sidewalls forming an enclosed chamber, the ink tank being detachably fixed to the tank holder of the head cartridge, the ink tank including a tank side ink joint at a lower portion of the ink tank chamber and connected to the head side ink joint when the ink tank is attached to the tank holder for communicating the ink between the head side ink joint and the tank side ink joint, and a porous ink keeper filling the chamber and in engagement with at least the sidewalls for supplying the ink to the head side ink joint, wherein when the ink tank is attached to the tank holder of the head cartridge and the head cartridge is attached to the head carriage, the ink tank is provided with the tank side ink joint connected at a lower end portion of the ink tank chamber and with an air communication hole formed at an upper end portion of the ink tank chamber for communication with air outside of the ink tank chamber, the ink tank chamber is configured to have an area in cross-section which increases from the bottom to the top of the ink tank chamber, and further the ink tank is configured to have at least one sidewall with a surface extending in a direction of movement of the head carriage to which the tank assembly is to be mounted sloping upwards in an outward direction from a sidewall opposite said sloping sidewall.

3. An ink-jet cartridge as claimed in claim 2, wherein the ink discharge nozzles discharge ink in a downward direction away from the top of the chamber when the head cartridge is attached to the head carriage.

4. An ink-jet recording apparatus comprising:

an ink-jet cartridge having a head cartridge including a tank holder, a head tip with a plurality of ink discharge nozzles, a head side ink joint for supplying ink to the ink discharge nozzles, and a manifold for temporarily holding the ink supplied from the head side ink joint to the ink discharge nozzles, and an ink tank having top, bottom, and sidewalls forming an enclosed chamber and removably held by and attached to the tank holder, the ink tank including a tank side ink joint provided at a lower portion of the ink tank chamber and connected to the head side ink joint when the ink tank is attached to the tank holder for communicating the ink between the head side ink joint and the tank side ink joint, and a porous ink keeper filling the chamber and in engagement with at least the sidewalls for communicating the ink between the head side ink joint and the tank side ink joint; and a head carriage detachably fixed to the head cartridge and driven to reciprocate in a main scanning direction, wherein when the ink tank is attached to the tank holder of the head cartridge and the head cartridge is attached to the head carriage, the ink tank is provided with the tank side ink joint located at a lower end portion of the ink tank chamber and with an air communication hole formed at an upper end portion of the ink tank chamber for communication with air outside of the ink tank, the ink tank is shaped such that the ink tank chamber is configured to have an area in cross-section which gradually increases from the bottom to the top of the ink tank chamber, and further the ink tank is configured to have at least one sidewall with a surface extending in the main scanning direction of the head carriage sloping upwards in an outward direction from a sidewall opposite said sloping sidewall.

* * * * *